US008500126B1

(12) United States Patent
Lo

(10) Patent No.: US 8,500,126 B1
(45) Date of Patent: Aug. 6, 2013

(54) METHODS OF PLAYING A MULTI-VARIANT POKER GAME

(76) Inventor: Kendrick Lo, Toronto (CA)

( * ) Notice: Subject to any disclaimer, the term of this patent is extended or adjusted under 35 U.S.C. 154(b) by 0 days.

(21) Appl. No.: 13/440,417

(22) Filed: Apr. 5, 2012

(51) Int. Cl.
*A63F 1/00* (2006.01)

(52) U.S. Cl.
USPC ..... 273/292

(58) Field of Classification Search
USPC ..... 273/292
See application file for complete search history.

(56) References Cited

U.S. PATENT DOCUMENTS 5,762,340 A * 6/1998 Feola ..... 273/292
7,727,060 B2 * 6/2010 Mills ..... 463/13

OTHER PUBLICATIONS

Wikipedia, "List of poker variants". Downloaded from the Internet at http://en.wikipedia.org/wiki/List_of_poker_variants on Apr. 5, 2012.
2013 World Series of Poker Official Dealer Guide, pp. 23-31: downloaded from the Internet, wsop.com/2013/2013_WSOP_Dealer_Guide.pdf, Jun. 12, 2013.
Badugi: downloaded from the Internet, http://en.wikipedia.org/wiki/Badugi, Jun. 12, 2013.
Baduci: downloaded from the Internet, http://en.wikipedia.org/wiki/Baduci, Jun. 12, 2013.
Omaha hold 'em: downloaded from the Internet, http://en.wikipedia.org/wiki/Omaha_poker, Jun. 12, 2013.
Razz (poker): downloaded from the Internet, http://en.wikipedia.org/wiki/Razz_(poker), Jun. 12, 2013.
Draw poker: downloaded from the Internet, http://en.wikipedia.org/wiki/Triple_draw, Jun. 12, 2013.
Community card poker: downloaded from the Internet, http://en.wikipedia.org/wiki/Community_card_poker, Jun. 12, 2013.
Lowball (poker): downloaded from the Internet, http://en.wikipedia.org/wiki/Kansas_city_lowball, Jun. 12, 2013.
Stud poker: downloaded from the Internet, http://en.wikipedia.org/wiki/Stud_poker, Jun. 12, 2013.
Seven-card stud: downloaded from the Internet, http://en.wikipedia.org/wiki/Seven_Card_Stud, Jun. 12, 2013.
How to Play Badacey: downloaded from the Internet, http://www.onlinebadugi.com/badugi-rules/badacey/, Jun. 12, 2013.
Razzdugi: downloaded from the Internet, http://www.raketracker.com/poker-rules/razzdugi.html.

* cited by examiner

*Primary Examiner* — Michael Dennis

(57) ABSTRACT

Methods of playing a multi-variant poker game using a standard 52-card deck of playing cards are described herein. In one embodiment, the poker game comprises hands associated with a specific combination of poker game variants that include Badugi, Badeucy, Pot Limit Omaha, Razz, Deuce-to-Seven Triple Draw, Razzdugi, Crazy Pineapple Hi-Lo, Fixed Limit Hold'em, Omaha Hi-Lo, Kansas City Lowball, Stud Hi-Lo, and Seven Card Stud.

20 Claims, 1 Drawing Sheet

| | | |
|---|---|---|
| 1 | **Ba** | **Ba**dugi |
| 2 | **By** | **B**adeucy |
| 3 | **A** | Pot Limit Om**a**ha |
| 4 | **R** | **R**azz |
| 5 | **T** | Deuce-to-Seven **T**riple Draw |
| 6 | **I** | Razzdug**i** |
| 7 | **C** | **C**razy Pineapple Hi-Lo |
| 8 | **H** | Fixed Limit **H**old'em |
| 9 | **O** | **O**maha Hi-Lo |
| 10 | **K** | **K**ansas City Lowball |
| 11 | **E** | Stud Hi-Lo (a.k.a. Seven Card Stud Hi-Lo **E**ight-or-Better) |
| 12 | **S** | Seven Card **S**tud |

100

| | | |
|---|---|---|
| 1 | **Ba** | **Ba**dugi |
| 2 | **By** | **B**adeuc**y** |
| 3 | **A** | Pot Limit Omah**a** |
| 4 | **R** | **R**azz |
| 5 | **T** | Deuce-to-Seven **T**riple Draw |
| 6 | **I** | Razzdug**i** |
| 7 | **C** | **C**razy Pineapple Hi-Lo |
| 8 | **H** | Fixed Limit **H**old'em |
| 9 | **O** | **O**maha Hi-Lo |
| 10 | **K** | **K**ansas City Lowball |
| 11 | **E** | Stud Hi-Lo (a.k.a. Seven Card Stud Hi-Lo **E**ight-or-Better) |
| 12 | **S** | Seven Card **S**tud |

100

METHODS OF PLAYING A MULTI-VARIANT POKER GAME

FIELD

Embodiments described herein relate generally to poker games, and more specifically, to methods of playing and offering for play a poker game using a standard 52-card deck of playing cards.

BACKGROUND

Numerous poker game variants have been developed to enhance player interest. Known poker game variants such as Seven Card Stud and, more recently, No Limit Hold'em have experienced considerable popularity.

The play of a hand of some poker game variants involves discarding and/or drawing of cards, while in other poker game variants, discarding and/or drawing individual cards are not permitted. The play of a hand of some poker game variants involves the use of community cards that are shared between all players and may be used by any player, whereas in other poker game variants, no cards are typically shared between players. In some poker game variants, accumulated wagers made during a hand (i.e. the "pot") are generally awarded to the player(s) with the highest ranking poker hand, whereas in other poker game variants, the accumulated wagers may be split amongst multiple players (e.g. between the player(s) with the highest ranking poker hand and the player(s) with the lowest ranking poker hand).

BRIEF DESCRIPTION OF THE DRAWING

FIG. 1 is a chart illustrating an example combination of different poker game variants playable in a method of playing and/or dealing a poker game in accordance with at least one embodiment.

DESCRIPTION

Many poker games played in a casino setting (e.g. land-based or online), whether in a tournament format in which tournament chips are used for wagering, or in a ring game format in which chips having a cash value are typically used for wagering, involve the dealing and playing of a single, specific poker game variant. As examples, a player may enter a No Limit Hold'em poker tournament, in which No Limit Hold'em is played exclusively, or a Pot Limit Omaha ring game, in which the poker game variant Pot Limit Omaha is played exclusively.

However, some poker games in which multiple poker game variants are played, are known. Poker games in which some combination of different poker game variants are played are steadily increasing in popularity. These multi-variant poker games (also referred to as "mixed games") may be seen by certain players as being less monotonous than single-variant games, and/or as a more challenging game where success demands a greater level of mastery of poker skills.

For example, a poker game in which five different poker game variants are played is known as H.O.R.S.E. The poker game variants played are as follows:

Fixed Limit Hold'em:

In the play of each hand, each player is dealt two private cards ("hole cards"). Five community cards are dealt. The object is to make the highest five-card poker hand using any combination of a player's two hole cards and the five community cards. There are four rounds of betting during the play of the hand, and the amount of each bet or raise is fixed for a given round.

Omaha Hi-Lo:

In the play of each hand, each player is dealt four private cards ("hole cards"). Five community cards are dealt. A five-card poker hand consists of exactly two of a player's hole cards and exactly three of the five community cards. The player(s) with the highest five-card poker hand wins one half of the pot, and the player(s) with the lowest five-card poker hand consisting of differently-ranked cards ranked eight or lower (ignoring straights and flushes) wins the other half of the pot. There are four rounds of betting during the play of the hand, and the amount of each bet or raise is typically fixed for a given round in H.O.R.S.E.

Razz:

In the play of each hand, each player is dealt two private cards ("hole cards"), followed by four cards dealt face-up which are not shared with other players, and a final, third private card for a total of seven cards. The object is to make the lowest five-card poker hand using any combination of a player's seven cards. Straights and flushes are ignored. There are five rounds of betting during the play of the hand, and the amount of each bet or raise is fixed for a given round.

Seven Card Stud:

In the play of each hand, each player is dealt two private cards ("hole cards"), followed by four cards dealt face-up which are not shared with other players, and a final, third private card for a total of seven cards. The object is to make the highest five-card poker hand using any combination of a player's seven cards. There are five rounds of betting during the play of the hand, and the amount of each bet or raise is fixed for a given round.

Stud Hi-Lo (also known as Seven Card Stud Eight-or-Better):

In the play of each hand, each player is dealt two private cards ("hole cards"), followed by four cards dealt face-up which are not shared with other players, and a final, third private card for a total of seven cards. The player(s) with the highest five-card poker hand, made using any combination of a player's seven cards, wins one half of the pot; the player(s) with the lowest five-card poker hand consisting of differently-ranked cards ranked eight or lower (ignoring straights and flushes) wins the other half of the pot. There are five rounds of betting during the play of the hand, and the amount of each bet or raise is fixed for a given round.

As a further example, a poker game in which eight different poker game variants are played is known as "Eight-Game Mix". The poker game variants played include those played in H.O.R.S.E. as noted above, with the following additions:

No Limit Hold'em:

In the play of each hand, each player is dealt two private cards ("hole cards"). Five community cards are dealt. The object is to make the highest five-card poker hand using any combination of a player's two hole cards and the five community cards. There are four rounds of betting during the play of the hand, and the maximum amount of each bet or raise is not fixed for any given round.

Pot Limit Omaha:

In the play of each hand, each player is dealt four private cards ("hole cards"). Five community cards are dealt. The object is to make the highest five-card poker hand using exactly two of a player's hole cards and exactly three of the five community cards. There are four rounds of betting during the play of the hand, and the maximum amount of each bet or raise depends on the size of the pot at the time the wager is made.

Deuce-to-Seven Triple Draw:

In the play of each hand, each player is dealt five private cards ("hole cards"). There are three drawing rounds. In each drawing round, the player may discard any number of hole cards, to be replaced by cards from the deck. The object is to make the lowest five-card poker hand upon completion of the drawing rounds. An Ace is considered as a high card only, and straights or flushes count against a hand. There are four rounds of betting during the play of the hand, and the amount of each bet or raise is fixed for a given round.

As a further example, a poker game in which ten different poker game variants are played is known as "Ten-Game Mix". The poker game variants played include those variants in Eight-Game Mix as noted above, with the following additions:

Badugi:

In the play of each hand, each player is dealt four private cards ("hole cards"). There are three drawing rounds. In each drawing round, the player may discard any number of hole cards, to be replaced by cards from the deck. The object is to make the lowest four-card hand comprised of differently-ranked cards of different suits (i.e. one card in each of Spades, Hearts, Diamonds, and Clubs) upon completion of the drawing rounds. Straights and flushes are ignored. There are four rounds of betting during the play of the hand, and the amount of each bet or raise is fixed for a given round.

Kansas City Lowball:

In the play of each hand, each player is dealt five private cards ("hole cards"). There is one drawing round in which the player may discard any number of hole cards, to be replaced by cards from the deck. The object is to make the lowest five-card poker hand upon completion of the drawing round. An Ace is considered as a high card only, and straights or flushes count against a hand. There are two rounds of betting during the play of the hand, and the maximum amount of each bet or raise is not fixed for any given round.

In accordance with at least one embodiment described herein, there is provided a method of playing a poker game using a standard 52-card deck of playing cards, wherein the poker game comprises hands associated with a novel and inventive combination of poker game variants.

In at least one embodiment, the poker game combines certain poker game variants of the known mixed games described above with a number of additional, lesser-known poker game variants. The relative obscurity of the additional poker game variants compared to better-known poker game variants may be attributed to the fact that some additional poker game variants may have been played more often in the past but their popularity has waned in recent times (e.g. Crazy Pineapple Hi-Lo) or that they have only been recently developed (e.g. Badeucy, Razzdugi).

The resultant combination of poker game variants in embodiments of the method described herein may enhance interest amongst players, and present a greater challenge of poker skills compared to known poker games.

Referring to FIG. 1, a chart is provided that illustrates a plurality of poker game variants, each of which one or more hands are played in a method of playing a poker game shown generally as 100, in accordance with one embodiment.

The individual poker game variants of the poker game are known, and some have been identified earlier in the present disclosure. One or more hands of a number of additional poker game variants are played in the method of playing the poker game 100, and these additional poker game variants include:

Badeucy:

In the play of each hand, each player is dealt five private cards ("hole cards"). There are three drawing rounds. In each drawing round, the player may discard any number of hole cards, to be replaced by cards from the deck. The player(s) with the lowest five-card poker hand upon completion of the drawing rounds wins one half of the pot; an Ace is considered as a high card, and straights or flushes count against a hand. The player(s) with the lowest four-card poker hand comprised of differently-ranked cards of different suits (i.e. one card in each of Spades, Hearts, Diamonds, and Clubs) upon completion of the drawing rounds wins the other half of the pot; an Ace is considered as a high card, and straights or flushes are ignored. There are four rounds of betting during the play of the hand, and the amount of each bet or raise is fixed for a given round.

Razzdugi:

In the play of each hand, each player is dealt two private cards ("hole cards"), followed by four cards dealt face-up which are not shared with other players, and a final, third private card for a total of seven cards. The player(s) with the lowest five-card poker hand using any combination of a player's seven cards wins one half of the pot; the player(s) with the lowest four-card poker hand comprised of differently-ranked cards of different suits (i.e. one card in each of Spades, Hearts, Diamonds, and Clubs) wins the other half of the pot. Straights and flushes are ignored. There are five rounds of betting during the play of the hand, and the amount of each bet or raise is fixed for a given round.

Crazy Pineapple Hi-Lo:

In the play of each hand, each player is dealt three private cards ("hole cards"). Three community cards are dealt, after which the player discards a selected one of the three hole cards. Two additional community cards are then dealt. A five-card poker hand consists of any combination of a player's two remaining hole cards and the five community cards. The player(s) with the highest five-card poker hand wins one half of the pot, and the player (s) with the lowest five-card poker hand consisting of differently-ranked cards ranked eight or lower (ignoring straights and flushes) wins the other half of the pot. There are four rounds of betting during the play of the hand, and the amount of each bet or raise is typically fixed for a given round.

While the individual poker game variants of the poker game associated with the embodiment illustrated with reference to FIG. 1 may be known, the specific combination disclosed is unique, and combines a number of lesser-known variants with relatively better-known variants, while excluding the popular variant of No Limit Hold'em. This may enhance interest of players seeking greater variety in a poker game. However, in a variant embodiment, the method of playing the poker game may further comprise playing one or more hands of No Limit Hold'em.

Furthermore, each of the poker game variants identified in FIG. 1 may be associated with a unique one or two-letter identifier, as shown in FIG. 1 by way of example. This allows the specific combination of poker game variants identified in FIG. 1 to be associated with a mnemonic, "BABY ARTICHOKES", as illustrated. This may facilitate easier memorization of the specific poker game variants to be played when the poker game is dealt or played.

Moreover, in one embodiment, the poker game variants identified in FIG. 1 may be played in the particular sequence as shown in FIG. 1 (e.g. one of more hands of poker game variant #1 [Badugi], followed by one or more hands of poker game variant #2 [Badeucy], and so on). This allows the above-noted mnemonic to be used to assist dealers and players in remembering the particular order in which hands of the different poker game variants are to be played when playing the poker game. Alternatively, in variant embodiments, the poker game variants may be played in an order other than that of the sequence depicted in FIG. 1. For example, a random order of the poker game variants may be determined for play of the poker game.

In variant embodiments, the play of the poker game variants identified in FIG. 1 may be repeated for one or more iterations. A given iteration need not begin with the play of the first-identified poker game variant identified in FIG. 1.

In one embodiment, each poker game variant may be played for a specified number of hands (e.g. 8 hands) before the next poker game variant in a sequence is to be played. In variant embodiments, each poker game variant may be played for at least a specified time period (e.g. 20 minutes) before the next poker game variant in the sequence is to be played.

In one embodiment, the poker game may be played in a tournament format, in which wagers in the poker game are made using tournament chips. In a variant embodiment, the poker game may be played in a ring game format, in which wagers in the poker game are made using chips and/or other objects (including e.g. currency objects) having a cash value.

In variant embodiments, certain modifications may be made to the poker game, while maintaining the utility of the above-noted mnemonic. For example, in one variant embodiment, Badugi may replace Razzdugi in the sequence depicted in FIG. 1, and the poker game variants Badeucy and Badacey (in that order, or vice-versa) may be identified instead as the first two poker game variants in the illustrated sequence. Badacey is similar to Badeucy except that an Ace counts as a low card when assessing the strength of the four-card hand, and straights and flushes are ignored. In another variant embodiment, Badacey may replace or alternate with Badeucy in the sequence of poker game variants depicted in FIG. 1. In another variant embodiment, Ace-to-Five Triple Draw may replace or alternate with Deuce-to-Seven Triple Draw in the sequence of poker game variants depicted in FIG. 1. Ace-to-Five Triple Draw is similar to Deuce-to-Seven Triple Draw except that an Ace counts as a low card, and straights and flushes are ignored. In another variant embodiment, Crazy Pineapple may replace or alternate with Crazy Pineapple Hi-Lo in the sequence of poker game variants depicted in FIG. 1. Crazy Pineapple is similar to Crazy Pineapple Hi-Lo, except the highest five-card hand wins the whole pot. In another variant embodiment, Knightsbridge may replace or alternate with Kansas City Lowball in the sequence of poker game variants depicted in FIG. 1. Knightsbridge is similar to Badeucy except that an Ace counts as a low card when assessing the strength of the four-card hand.

In another variant embodiment, one or more of Omaha Hi-Lo (also known as "Omaha Hi-Lo Eight-or-Better"), Crazy Pineapple Hi-Lo (also known as "Crazy Pineapple Hi-Lo Eight-or-Better"), and Stud Hi-Lo (also known as "Stud Hi-Lo Eight-or-Better"), may be replaced or alternate with Omaha Hi-Lo No Qualifier, Crazy Pineapple Hi-Lo No Qualifier, and Stud Hi-Lo No Qualifier (despite Stud Hi-Lo No Qualifier not typically being associated with the identifier 'E') respectively. The No Qualifier variations of the corresponding Hi-Lo poker game variants do not require that the low hand comprise differently-ranked cards of rank lower than eight.

In another variant embodiment, Seven Card Stud may be removed from the sequence of FIG. 1, with the resulting combination of poker game variants represented by the abbreviated mnemonic "BABY ARTICHOKE".

The skilled person will appreciate that all of the poker game variants identified herein utilize a standard 52-card deck of playing cards. This may increase convenience, particularly when offering the poker game for play as described herein with respect to various embodiments.

A number of poker game variants to be played in a method of playing a poker game, in accordance with a number of embodiments, have been described herein. A poker game in accordance with at least one of the embodiment described herein may also be offered for play by an entity to players, in which one or more hands of each of the poker game variants in the poker game are dealt. The method of offering the poker game for play may be performed in a card room, for example. The method of offering the poker game for play may be performed in a casino, for example. As a further example, the method of offering the poker game for play may be performed by at least one processor of a server communicatively coupled to a plurality of player computing devices (e.g. mobile devices), over a network (e.g. the Internet) for example, to the extent that offering the poker game is permitted by law.

The invention claimed is:

1. A method of offering a poker game to be played using a standard 52-card deck of playing cards, wherein the poker game comprises hands associated with a plurality of different poker game variants, the method comprising:

a) dealing one or more hands of Badugi;
b) dealing one or more hands of at least one of Badeucy or Badacey;
c) dealing one or more hands of Pot Limit Omaha;
d) dealing one or more hands of Razz;
e) dealing one or more hands of at least one of Deuce-to-Seven Triple Draw or Ace-to-Five Triple Draw;
f) dealing one or more hands of Razzdugi;
g) dealing one or more hands of at least one of Crazy Pineapple Hi-Lo or Crazy Pineapple;
h) dealing one or more hands of Fixed Limit Hold'em;
i) dealing one or more hands of Omaha Hi-Lo;
j) dealing one or more hands of Kansas City Lowball;
k) dealing one or more hands of Stud Hi-Lo; and
l) dealing one or more hands of Seven Card Stud wherein the method is performed by at least one processor of a server communicatively coupled to a plurality of player computing devices.

2. The method of claim 1, wherein a) to l) are performed in sequence.

3. The method of claim 1, wherein a) to l) are performed in a random order.

4. The method of claim 1, further comprising dealing one or more of hands of No Limit Hold'em.

5. The method of claim 1, wherein wagers in the poker game are made using tournament chips.

6. The method of claim 1, wherein wagers in the poker game are made using chips having a cash value.

7. The method of claim 1, wherein each of a) to l) is performed for at least a specified time period.

8. The method of claim 1, wherein each of a) to l) is performed for a specified number of hands.

9. The method of claim 1, wherein Stud Hi-Lo comprises at least one of Stud Hi-Lo Eight-Or-Better or Stud Hi-Lo No Qualifier, wherein Omaha Hi-Lo comprises at least one of Omaha Hi-Lo Eight-Or-Better or Omaha Hi-Lo No Qualifier, and wherein Crazy Pineapple Hi-Lo comprises at least one of Crazy Pineapple Hi-Lo Eight-Or-Better or Crazy Pineapple Hi-Lo No Qualifier.

10. The method of claim 1, wherein the method is performed in a casino.

11. A server computing device configured to offer a poker game to be played using a standard 52-card deck of playing cards, wherein the poker game comprises hands associated with a plurality of different poker game variants, wherein the server apparatus is communicatively coupled to a plurality of player computing devices, wherein the server computing device comprises:

at least one processor, the at least one processor being configured to:

a) deal one or more hands of Badugi;

b) deal one or more hands of at least one of Badeucy or Badacey;

c) deal one or more hands of Pot Limit Omaha;

d) deal one or more hands of Razz;

e) deal one or more hands of at least one of Deuce-to-Seven Triple Draw or Ace-to-Five Triple Draw;

f) deal one or more hands of Razzdugi;

g) deal one or more hands of at least one of Crazy Pineapple Hi-Lo or Crazy Pineapple;

h) deal one or more hands of Fixed Limit Hold'em;

i) deal one or more hands of Omaha Hi-Lo;

j) deal one or more hands of Kansas City Lowball;

k) deal one or more hands of Stud Hi-Lo; and l) deal one or more hands of Seven Card Stud.

12. The server computing device of claim 11, wherein the at least one processor is configured to perform a) to l) in sequence.

13. The server computing device of claim 11, wherein the at least one processor is configured to perform a) to l) in a random order.

14. The server computing device of claim 11, wherein the at least one processor is further configured to deal one or more of hands of No Limit Hold'em.

15. The server computing device of claim 11, wherein wagers in the poker game are made using tournament chips.

16. The server computing device of claim 11, wherein wagers in the poker game are made using chips having a cash value.

17. The server computing device of claim 11, wherein the at least one processor is configured to perform each of a) to l) for at least a specified time period.

18. The server computing device of claim 11, wherein the at least one processor is configured to perform each of a) to l) for a specified number of hands.

19. The server computing device of claim 11, wherein Stud Hi-Lo comprises at least one of Stud Hi-Lo Eight-Or-Better or Stud Hi-Lo No Qualifier, wherein Omaha Hi-Lo comprises at least one of Omaha Hi-Lo Eight-Or-Better or Omaha Hi-Lo No Qualifier, and wherein Crazy Pineapple Hi-Lo comprises at least one of Crazy Pineapple Hi-Lo Eight-Or-Better or Crazy Pineapple Hi-Lo No Qualifier.

20. The server computing device of claim 11, wherein the server computing device is associated with a casino.

* * * * *